US005375982A

United States Patent [19]

Joosse et al.

[11] Patent Number: 5,375,982

[45] Date of Patent: Dec. 27, 1994

[54] RADIAL PUMP

[75] Inventors: Wiecher J. H. Joosse, Best; Albertus C. Schermers, Almkerk; Wijnand F. Groen, Breugel, all of Netherlands

[73] Assignee: Gentec B.V., Son, Netherlands

[21] Appl. No.: 119,224

[22] PCT Filed: Apr. 8, 1992

[86] PCT No.: PCT/NL92/00066

§ 371 Date: Oct. 27, 1993

§ 102(e) Date: Oct. 27, 1993

[87] PCT Pub. No.: WO92/18769

PCT Pub. Date: Oct. 29, 1992

[30] Foreign Application Priority Data

Apr. 10, 1991 [NL] Netherlands ..... 9100629

[51] Int. Cl.[5] ..... F04B 1/04; F04B 43/02

[52] U.S. Cl. ..... 417/273; 92/84

[58] Field of Search ..... 417/273; 92/84; 91/494

[56] References Cited

U.S. PATENT DOCUMENTS

| | | | |
|---|---|---|---|
| 862,867 | 8/1907 | Eggleston | 417/472 |
| 2,871,846 | 2/1959 | Zimmerman | 417/273 X |
| 3,091,738 | 2/1962 | Zubaty | 417/273 X |
| 4,179,244 | 12/1979 | Marple | 417/273 |
| 4,538,965 | 9/1985 | Dantlgraber et al. | 417/273 |
| 4,673,337 | 6/1987 | Miller | 417/273 |
| 4,721,444 | 1/1988 | Pareja | 417/273 X |

FOREIGN PATENT DOCUMENTS

| | | |
|---|---|---|
| 0092264 | 10/1983 | European Pat. Off. . |
| 2123032 | 9/1972 | France . |
| 1528504 | 7/1970 | Germany . |

*Primary Examiner*—Richard E. Gluck
*Attorney, Agent, or Firm*—Young & Thompson

[57] ABSTRACT

Radial pump with a rotary shaft (4) on which an eccentric (6) is fitted. A sleeve (8) to which a plurality of pistons (12) is connected is fitted rotatably on the eccentric (6). The connection between the sleeve (8) and the pistons (12) is achieved by a part made of elastically deformable material (9) which is fitted around the sleeve (8). A controlled opening and closing movement of the pistons is thus obtained through rotation of the pump shaft (4). More than one series of pistons can be fitted around the shaft.

6 Claims, 2 Drawing Sheets

RADIAL PUMP

The invention relates to a radial pump to the preamble of claim 1.

BACKGROUND OF THE INVENTION

A radial pump is known from the book "Die Pumpen Arbeitsweise Berechnung Konstruktion", 13., neubearbeitete Auflage", published by Springer-Verlag Berlin Heidelberg New York 1977, FIG. 74.5 of Hellmuth Schulz. In this case the connecting part is designed as in the case of a crosshead internal combustion engine, i.e. it is composed of a piston-cylinder guide which is connected at one side to the eccentric by means of a drive rod and at the other side to the pump piston by means of a fixed pin which carries out only a to and fro movement. This produces a complex construction with a large number of bearing points. All these bearing points have to be lubricated. If adequate lubrication cannot be ensured, rolling bearings must be used. This involves a large amount of space and more noise during rotation. Although rolling bearings have lower requirements as regards lubrication than plain bearings, it nevertheless remains necessary to provide lubrication.

European Patent Specification 0,165,876 discloses a radial pump in which no sleeve is fitted on the eccentric and the pistons run as cam followers on the eccentric. Although the large number of bearings mentioned above is not necessary in such a design, it does mean that the lubrication requirements are greater, due to the surfaces of the piston and the eccentric moving along each other. It is also necessary to provide special means for moving back the piston. In the European patent this is achieved by means of coil springs. The disadvantage of this is that control of the return movement is difficult to manage at higher speeds of rotation, certainly if a low spring pressure is being aimed at, in order to limit the power consumption by the pump as much as possible.

A radial pump according to the preamble of claim 1 is known from FR-A-2123032. From this specification frictional engagement of the plunger to the sleeve is known. The plunger is urged against the sleeve by means of a resilient leaf spring. Several of such leaf springs are provided and each leaf spring connects to opposite positioned plungers and is for that reason circular shaped. No further support for each circular leaf spring is provided. This means that return movement of the plunger is controlled by spring characteristics of the leaf springs. The eccentric to which the end of the plunger engages will not only urge the plunger to-and-fro but will also displace laterally relative to the contact face between the plunger and the sleeve surface. This means that there will be some friction between the sleeve and the plunger end.

SUMMARY OF THE INVENTION

The invention aims to avoid such friction forces between the sleeve and the plunger end whilst on the other accurate control of the plunger relative to the sleeve is guaranteed, i.e. both during the work hub and during the return hub the plunger path has to be accurately controlled by the sleeve.

According to the invention this is realized with the measures of the characterizing part of claim 1. Instead of using plain or rolling bearings for fixing of the "drive rods" to the sleeve, according to the invention a part made of elastically deformable material in which the drive rods are accommodated is used. This eliminates the problems with lubrication, but controlled to and fro movement of the pistons is still ensured. The nature of the elastically deformable material ensures that load peaks can be avoided. Through the avoidance of load peaks, premature wear and excessive noise caused by the pump can be limited considerably. Due to the fact that the lubrication requirements are lower now, it is possible to use the pump described above for pumping fluids in the case of which the seal to the control mechanism produces very many problems, and the fluids themselves, for example liquefied petroleum gas (LPG), have very poor lubrication properties.

The piece of material can be placed as a ring around the sleeve and fixed to it. It is, of course, possible for the sleeve and the elastically deformable material to be made of one piece of the same material.

According to an advantageous embodiment of the invention, the elastically deformable material is a rubber material. In rubber technology many materials which can be elastically deformed a very great number of times without showing fatigue symptoms are known. In addition, the damping properties of rubber material are advantageous, in order to avoid load peaks as much as possible.

According to a further advantageous embodiment of the invention, each piston contains a diaphragm wedged in the pump chamber which achieves guidance of the piston. This means that the piston can tilt slightly, and a particularly good seal can be achieved between the pump chamber and the space in which the eccentric with the elastically deformable part is placed. There are consequently still possibilities for providing lubrication between the sleeve and the eccentric.

According to a further advantageous embodiment of the invention, the piston is provided with a rod firmly fixed to it, which rod in turn engages in the elastically deformable material. Where rubber is used as the elastically deformable material, fixing by vulcanisation has proved to be particularly advantageous.

BRIEF DESCRIPTION OF THE DRAWINGS

The invention will be explained in greater detail below with reference to an example of an embodiment shown in the drawing, wherein.

DETAILED DESCRIPTION OF THE INVENTION

Figure 1:
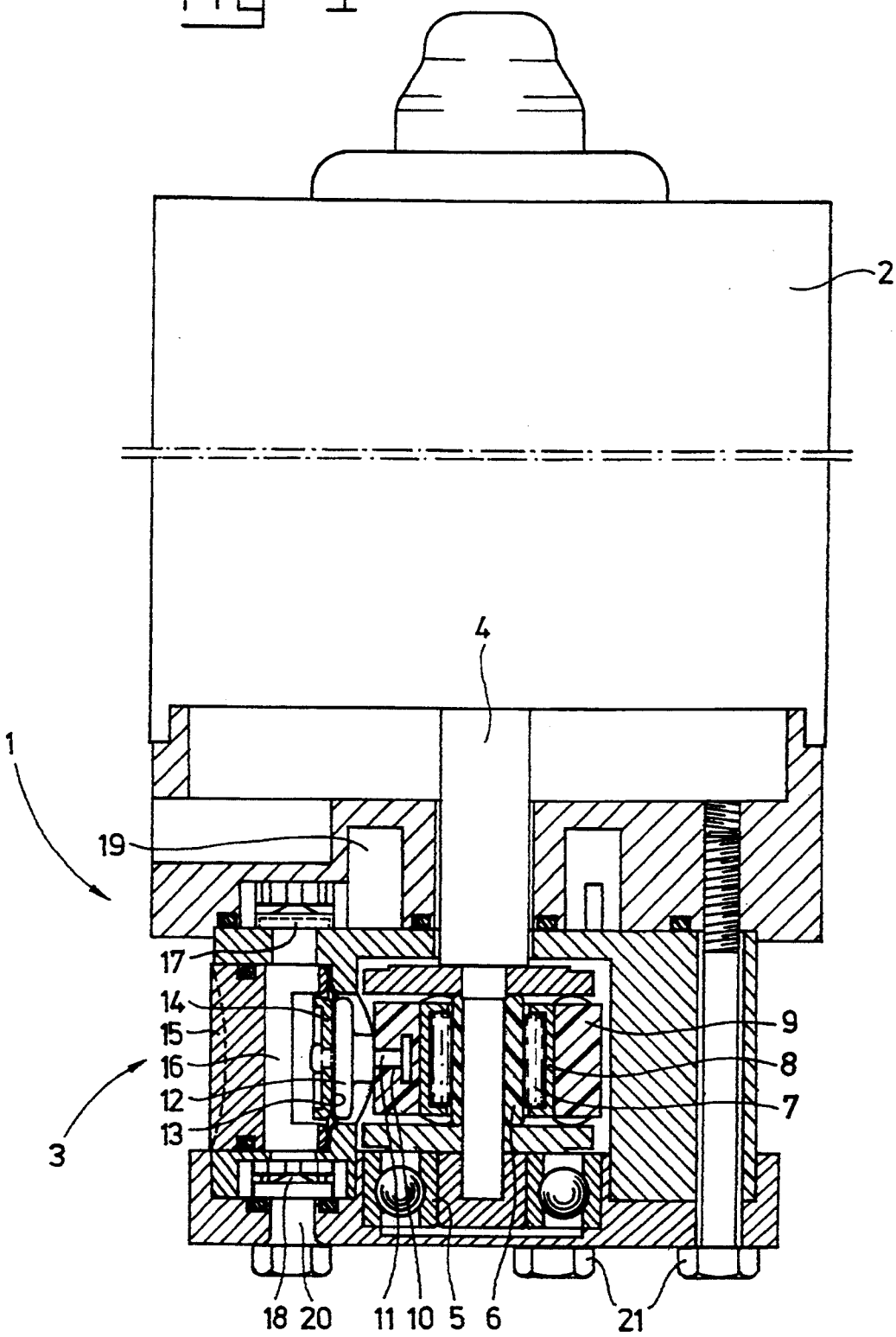
FIG. 1 shows in cross-section a first radial pump according to the invention.

The radial pump according to the invention is indicated in its entirety by 1. It comprises a motor part 2 and a pump part 3. This radial pump can be fitted in, for example, a pressure vessel for liquefied petroleum gas. Of course, the pump is not limited to this application.

A drive shaft 4, which is supported in pump part 3 by bearing ring 5, comes out of motor part 2. An eccentric 6 is fixed on motor shaft 4. Needle bearings 7, which are accommodated in a sleeve 8, are provided around eccentric 6. A part 9 made of elastically deformable material, such as rubber, is firmly fixed on sleeve 8. It is provided with holes 10 in which rods 11 (one shown) of pistons 12 engage. Pistons 12 are provided with diaphragms 13, which are clamped on the head of the piston by means of a clamping plate 14, and at the other side are wedged in the pump housing 15 for the purpose of bounding a pump chamber 16. Pump chamber 16 is provided with an inlet valve 18 and an outlet valve 17. Since these valves are not important for the functioning of the present invention, they are shown only schematically. Inlet valve 18 is connected to an inlet 20, while outlet valve 17 is connected to an outlet 19. Pump housing 15 is coupled by means of bolts 21 to motor 2.

The device described above works as follows:

During the operation of the pump, shaft 4 will turn. Eccentric 6 will turn with it, while sleeve 8 will remain in place through the presence of bearing ring 7, but will carry out a to and fro movement. Since only one rod 11 can be fixed to the sleeve 8 in that position, it is necessary to provide for the possibility of movement of a series of pistons for the other rods 11. According to the invention, this is achieved by the presence of the part made of rubber material in which the rods 11 are accommodated, more particularly the holes 10 in the part made of rubber material. This accommodation can be achieved by, for example, vulcanisation. The piston 12 is guided at the other side into the pump chamber by means of diaphragm 13. During the rotation of shaft 4, piston 12 will carry out a slightly tilting to and fro movement, in the course of which rod 11 carries out a pivoting movement in the deformable part 9. The occurrence of vacuum or excess pressure in chamber 16 will cause valve 18 or 17 respectively to open and material to be pumped out of inlet 20 under raised pressure to outlet 19. The use of elastically deformable material, which is preferably rubber material, means that it is no longer necessary to provide a large number of components for bearing. In addition, load peaks of the piston, which occur particularly in the bottom and top dead center, will be damped as much as possible, with the result that the noise of the pump decreases and its service life increases. The degree of damping and the elasticity before the rod 11 can be regulated by a suitable choice of the quantity of material surrounding rod 11 and the distance from sleeve 8. In the case of the construction described above it is possible to achieve a great displacement volume in a very limited space. The pump described above can be used in particular for pumping LPG, but it must be understood that it is not limited to that use, and that it is possible to pump other fluids with such a pump.

Figure 2:
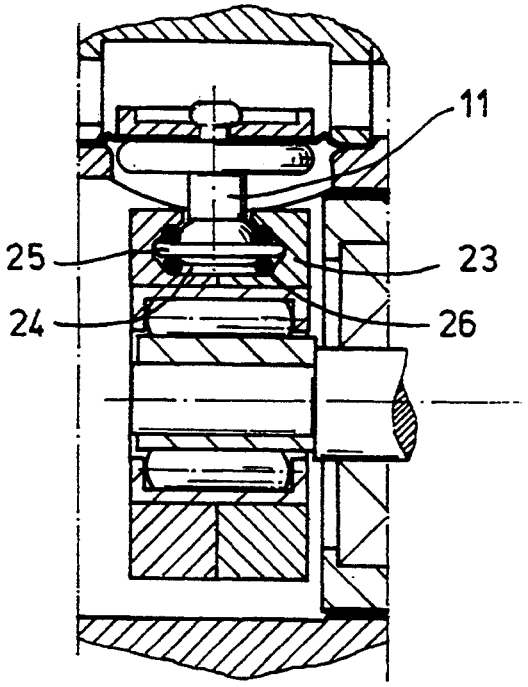
FIG. 2 shows in cross section a further embodiment of the invention.

In FIG. 2 a further embodiment of the pump according to the invention is shown. This pump can be driven with the same motor as the pump shown in FIG. 1 and because of that details relating thereto have been omitted.

In contrast to the embodiment of FIG. 1 rod 11 is not received in an elastically deformable bush but it is received in opening 24 of sleeve 23. Rod 11 is provided near its end to be received in sleeve 23 with a circumferential projection 25. At both sides of this circumferential projection elastically deformable links 26, such as O-rings, are provided. In this way a rubber elastic pivot point is arranged.

From comparison of both the embodiments of FIG. 1 and FIG. 2 it is clear that the elastically deformable part can be realized in several ways. For the invention it is only essential that the pivot between the rod and the sleeve comprises an elastically deformable material.

We claim:

1. In a radial pump: a rotary shaft having an eccentric fitted thereon, a sleeve radially fitted to said eccentric, a plurality of pistons disposed in a chamber, each piston pistons being connected to said sleeve via connecting means, said connecting means including an elastically deformable rubber portion and a pivoting part directly connected to said sleeve substantially opposite to the connection of the pivoting part to each said piston in the direction of movement of such piston.

2. Radial pump according to claim 1, wherein the elastically deformable rubber portion comprises a bush mounted around the sleeve and provided with an opening for receiving the pivoting part.

3. Radial pump according to claim 1, wherein the sleeve is provided with an opening for receiving the pivoting part, said pivoting part being provided at its end near the sleeve with a circumferential projection wherein between the wall of the opening and the projection at least an elastically deformable ring is provided.

4. Radial pump according to claim 1, wherein each piston has a diaphragm which is clamped in the chamber, and which guides the piston.

5. Radial pump according to claim 4, wherein the pivoting part is a rod which is engaged in the elastically deformable rubber portion.

6. Radial pump according to claim 5, wherein the rod is vulcanized in the rubber portion.

* * * * *